United States Patent [19]

Hildebrand

[11] Patent Number: 4,543,162

[45] Date of Patent: Sep. 24, 1985

[54] MULTI-PLY HEADBOX HAVING ADJUSTABLE OUTLET SLICES

[75] Inventor: Otto Hildebrand, Taldorf, Fed. Rep. of Germany

[73] Assignee: Escher Wyss Limited, Ravensburg, Fed. Rep. of Germany

[21] Appl. No.: 512,397

[22] Filed: Jul. 11, 1983

[30] Foreign Application Priority Data

Jul. 20, 1982 [CH] Switzerland ..... 4416/82

[51] Int. Cl.[4] ..... D21F 1/02

[52] U.S. Cl. ..... 162/343; 162/344

[58] Field of Search ..... 162/343, 347, 344, 346

[56] References Cited

U.S. PATENT DOCUMENTS

| | | | |
|---|---|---|---|
| 3,598,696 | 8/1971 | Beck | 162/343 |
| 4,089,739 | 5/1978 | Hildebrand | 162/343 |
| 4,141,788 | 2/1979 | Justus | 162/343 |
| 4,146,427 | 3/1979 | Hogel et al. | 162/343 |
| 4,181,568 | 1/1980 | Ptaler | 162/343 |
| 4,221,635 | 9/1980 | Kurtz et al. | 162/343 |
| 4,322,816 | 2/1983 | Wolf et al. | 162/343 |

*Primary Examiner*—Steve Alvo

*Attorney, Agent, or Firm*—Werner W. Kleeman

[57] ABSTRACT

The multi-ply headbox has a number of, for example, three headbox elements comprising block-like infeed members containing mutually parallel distributor passages for the fiber stock suspension which open each into a nozzle chamber. Plate-like intermediate lip members or lips bound the nozzle chambers and are provided between the headbox elements. The plate-like intermediate lips are displaceably arranged between the infeed members. There are also provided outer lips or lip members which either can be structured as displaceable plates or may be constructed to be pivotable. One of the outlet slices can be altered without affecting the size of the other slices.

19 Claims, 6 Drawing Figures

MULTI-PLY HEADBOX HAVING ADJUSTABLE OUTLET SLICES

BACKGROUND OF THE INVENTION

The present invention relates to a new and improved construction of multi-ply headbox.

In its more particular aspects, the present invention relates to a new and improved multi-ply headbox comprising a number of headbox elements, each of which contains an infeed member provided with turbulence elements for the fiber stock suspension and a nozzle chamber connected after the infeed member. The nozzle chambers of the headbox elements are bounded or delimited by outer lips or lip members and at least one intermediate lip or lip member located between the nozzle chambers. At least part of the lips is adjustable or displaceable for adjustment of the size of the outlet slice of the nozzle chambers.

In such general type of a multi-ply headbox as known, for example, from German Pat. No. 899,896, the intermediate lip has the shape of a tongue member which is pivotable within the nozzle chamber. Additionally, also one of the outer lips is pivotably arranged.

In such prior art headbox a precise adjustment of the size of the outlet slice, by pivoting an inner intermediate lip, can only be obtained with great difficulty, particularly considering the deformation of the lip which is to be expected across the width of the machine and considering the accuracy required for the adjustment. Furthermore, in the known headbox construction an adjustment of the intermediate lip not only affects the size of one of the outlet slices, but at the same time the size of the other outlet slice, and specifically in the converse sense. Due to the risk of deformation by torsion or twisting and the related change in the size of the two outlet slices separated from each other by the intermediate lip, such a pivotable intermediate lip must be equally loaded at both sides or faces thereof, i.e., the pressures prevailing in the two nozzle chambers must be equal.

SUMMARY OF THE INVENTION

Therefore, with the foregoing in mind it is a primary object of the present invention to provide a new and improved construction of multi-ply headbox for a papermaking machine which enables the nozzle chambers to be charged with liquid fiber stock suspensions having flow rates and pressures which are mutually independent of each other.

Another important object of the present invention is directed to the provision of a new and improved construction of multi-ply headbox for a papermaking machine which enables using only part of the headbox elements in the event that paper containing a smaller number of plies or layers is to be produced in comparison to the number of plies or layers for which the headbox is normally intended or designed.

Still a further significant object of the present invention is directed to a new and improved construction of a multi-ply headbox for a papermaking machine which permits precise adjustment of the size of the outlet slices of such headbox.

Another very important object of the present invention is directed to a new and improved construction of a multi-ply headbox for a papermaking machine which permits the size of one outlet slice of the headbox to be adjusted without affecting the size of an adjacent outlet slice thereof.

Now in order to implement these and still further objects of the invention, which will become more readily apparent as the description proceeds, the multi-ply headbox of the present development is manifested by the features that, the infeed members comprise substantially wedge-like converging side walls and are provided with distributor or distributing channels or passages for the stock suspension arranged substantially parallel to each other. Moreover, at least the intermediate lips or lip members are arranged for displacement along the side walls between the infeed members in the flow direction of the fiber stock suspension.

By virtue of the aforementioned measures there is obtained a simple construction of the inventive headbox in which the intermediate lips or lip members can assume the form or shape of plates or plate members which can be precisely adjusted by means of a simple adjusting or adjustment mechanism. The adjustment of one lip will only affect the size of one of the outlet slices, namely that one which is bounded by the lip. Additionally, the intermediate lips or lip members can be designed to be sufficiently rigid and can be sufficiently rigidly guided so as to withstand significant pressure differences between the individual nozzle chambers.

In a preferred embodiment of the multi-ply headbox according to the invention, the outer lips or lip members are also arranged for displacement along substantially flat or planar side walls of the outer infeed members. A simplification in the design of the headbox is thereby achieved, since the outer lips and their associated adjusting mechanism may be constructed substantially identical to the intermediate lips.

Preferably, the lips or lip members may have the shape of plates bounded or delimited by parallel planar surfaces. Consequently, there is obtained a particularly simple design of the lips or lip members which can be fabricated from sheet metal plates or metal plating.

It is preferred to associate a guide or guiding member with each lip. The guiding member is secured to the related infeed member and forms mechanical guiding or guide means for the relevant plate forming the lip or lip member. A further simplification in the design of the headbox is thus obtained, since the infeed members may be constructed more simply by locating the guiding means for the plate forming the lip upon an essentially planar or flat guiding or guide member.

However, a modification of the headbox is also conceivable in which the outer lips or lip members are pivotably supported at the region of the outer walls of the outer infeed members and in which the outer lips are pivotable in order to adjust or set the size of the outlet slice.

In a preferred design of the headbox the outer lips can contain outwardly bent ends which are flexed or bent such that the outlet slices formed between the outer lips and the intermediate lips are bounded by surfaces which extend substantially parallel to each other. In this manner there is obtained an improved guiding of the flow of the stock suspension in the outlet slices bounded by the outer lips or lip members.

Preferably the infeed members may comprise blocks formed of a solid material and possessing in each such block a plurality of preferably parallel bores constituting the distributing channels or passages. Such a design is known as such from the commonly assigned U.S. Pat.

No. 4,087,321, granted May 2, 1978, and has the advantage of particular simplicity and rigidity. Significant in this regard is also the commonly assigned U.S. Pat. No. 4,089,739, granted May 16, 1978.

It is particularly advantageous to provide the distributing or distributor channels passages formed in the block with step-shaped widening or widened portions which are also known from the aforementioned U.S. Pat. Nos. 4,087,321 and 4,089,739.

Furthermore, the intermediate lips or lip members may be provided with flexible foils which extend beyond the outlet slices.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENT

Figure 1:
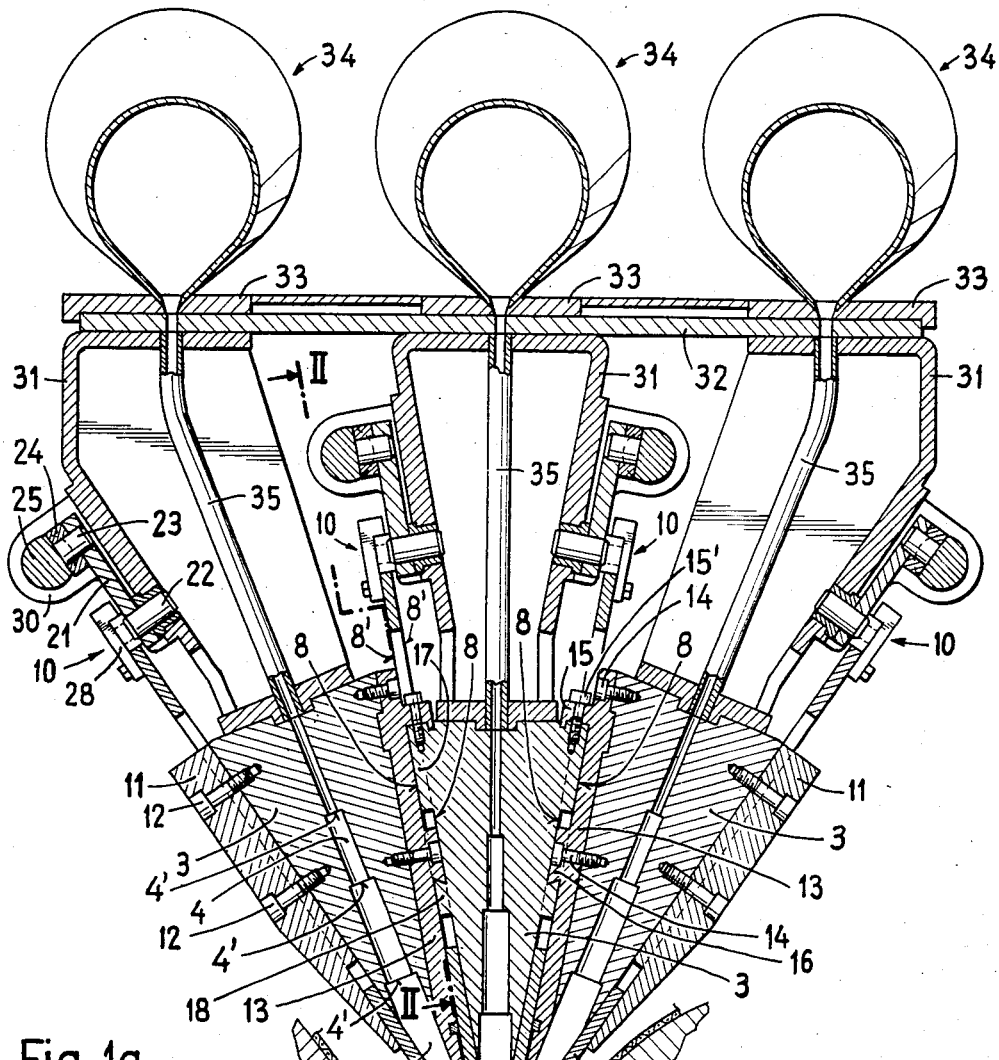
FIG. 1 is a cross-section through a first embodiment of a multi-ply headbox constructed according to the present invention.

Describing now the drawings, it is to be understood that only enough of the construction of the multi-ply headbox has been shown as needed for those skilled in the art to readily understand the underlying principles and concepts of the present development, while simplifying the showing of the drawings. Turning attention now specifically to FIG. 1, there has been illustrated therein in section a headbox suitable for for use with a conventional twin-wire papermaking machine, which therefore only has been generally indicated by two wire rollers or cylinders 1 equipped with wires or sieves 2. The headbox contains three headbox elements, each of which comprises an infeed member 3 containing distributing or distributor channels or passages 4 for the stock suspension as well as a nozzle chamber 5. The nozzle chambers 5 of the headbox elements communicate with the related infeed members 3 and are bounded or delimited by outer lips or lip members 6 and by intermediate lips or lip members 7. The illustrated infeed members 3 are shaped as blocks formed from solid material containing bores formed therein in order to provide the distributor or distributing channels 4 equipped with step-like widening or widened portions 4' defining turbulence elements.

The infeed members 3 possess wedge-like converging side walls 8, and the outer lip members 6 and the intermediate lip members 7 are guided along these side walls 8. By means of an adjustment mechanism 10 each outer lip member 6 and intermediate lip member 7 is displaceably arranged in the flow direction of the stock suspension in the distributor channels or passages 4, i.e., in the showing of FIG. 1 at an angle or inclination downwardly or upwardly, wherein this adjustment or displacement mechanism 10 has been shown in front view in FIG. 2.

In the embodiment of headbox shown in FIG. 1, the outer lip members 6 and the intermediate lip members 7 have the shape of plates which are bounded by parallel planar or flat surfaces 8' at the region between these infeed members 3 such that these lips or lip members may be fabricated, for example, from sheet material or metal plating.

Outer guiding or guide members 11 are operatively associated with the outer lip members 6 and mounted by, for example, threaded bolts 12 or equivalent structure to the related infeed member 3. Guiding or guide members 13 are operatively associated with the intermediate lip members 7 and are mounted to the outer infeed members 3 by threaded bolts 14 or equivalent structure. The guiding or guide members 13 simultaneously serve to connect the related outer infeed member 3 to which they are connected to the inner infeed member 3 as shown in FIG. 1. For this purpose the guiding members 13 are provided with projections 15 and 16 and with threaded bolts 15', the arrangement of which will also be evident from FIG. 2. The central or intermediate infeed member 3, on the other hand, is provided with projections 17 and 18 which cooperate with the projections 15 and 16, as shown.

Figure 2:
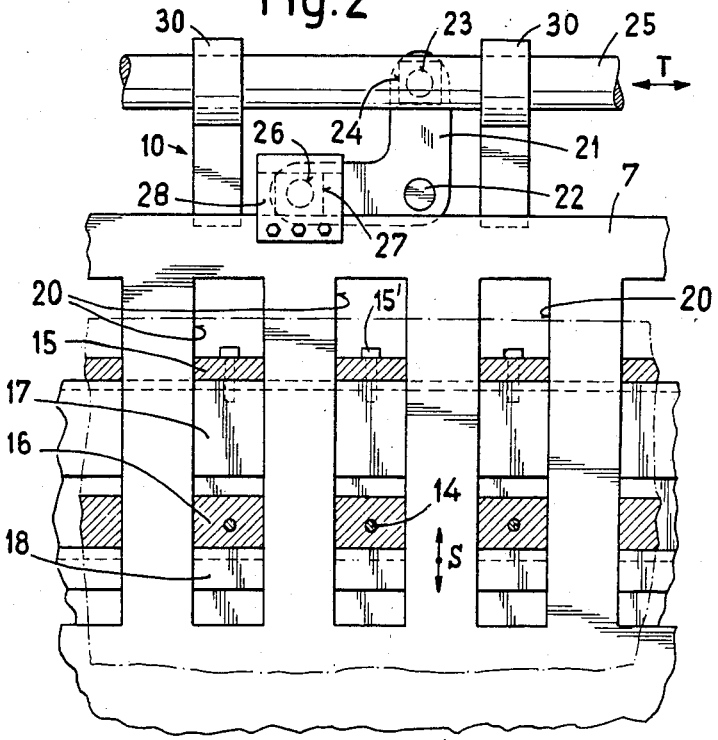
FIG. 2 is a partial sectional view, taken substantially along the line II–II of FIG. 1.

As will be evident from FIG. 2, the intermediate lip members 7 are provided with slots 20 into which extend the projections 15, 16, 17 and 18. These projections serve as spacers and as guides for the intermediate lip members 7. Each intermediate lip member 7 is displaceable in the direction of the double-headed arrow S. These projections 15, 16, 17, 18 may contain inclined surfaces as shown, and advantageously serve to provide a so-called dovetail connection arrangement for interconnecting the infeed members 3.

The adjustment or displacement mechanism 10 for thusly displacing the related intermediate lip member 7 comprises a bell-crank or angle lever 21 which is pivotable about a pivot pin 22 and carries at one arm or leg thereof a pin 23 which engages by means of a sliding block 24 a recess formed in an adjustment or displacing rod or rod means 25 defining a transversely extending rod member. The adjustment or displacing rod 25 is displaceable in the direction of the double-headed arrow T in accordance with the illustration of FIG. 2. The other arm or leg of the bell-crank or angle lever 21 is provided with a pin 26 surrounded by a sliding block 27 which is movable in a not particularly referenced groove formed in a member or part 28 which is secured by, for instance, bolts to the related outer lip member 6 or intermediate lip member 7. The adjustment or displacing rod 25 is guided in eyelets 30 or the like which are mounted together with the pins or pin members 22 at a supporting structure 31.

The supporting or support structure 31 simultaneously serves to attach a plate or plate member 32 to which there are connected plate-shaped connecting members 33 of manifold or distributor tubes 34. Connecting pipes or lines 35 lead from the distributor tubes 34 to the individual distributor or distributing channels 4 provided in the infeed members 3.

Figure 3:
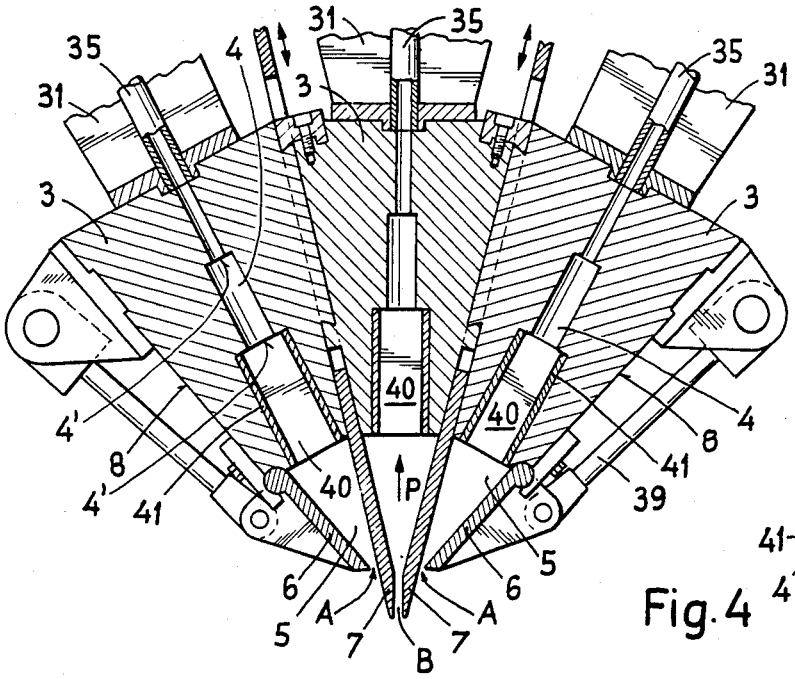
FIG. 3 is an illustration of a second embodiment of headbox according to the invention, showing a part thereof in a view corresponding to FIG. 1.

A further embodiment of headbox designed according to the teachings of the invention is shown in FIG. 3, and components or parts thereof which correspond to the same or identical parts shown in FIG. 1 have been conveniently designated by the same reference numerals. This embodiment differs from the first described embodiment primarily in that here the outer lip members 6 are pivotably mounted at the region of the side walls 8 of the outer infeed members 3. The adjustment of the size of the outlet slice A is effected by pivoting the outer lip members 6 by using a conventional adjustment or adjusting mechanism 39. The desired size of the central or intermediate outlet slice B is obtained by appropriately displacing the intermediate lip members 7 as described with reference to the first embodiment shown in FIG. 1.

Figure 4:
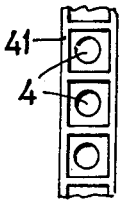
FIG. 4 is a view of the headbox shown in FIG. 3 looking essentially in the direction of the arrow P thereof.

A further difference in relation to the first embodiment depicted in FIG. 1 is that here the distributing or distributor channels 4 comprise end or terminal sections 40 configured in the form of continuous slots in which, in accordance with the showing FIG. 4, a lattice-shaped honeycomb member 41 is arranged. These end or terminal sections 40 of the individual distributor channels 4 thus have imparted thereto a substantially rectangular cross-sectional configuration.

Figure 1A:
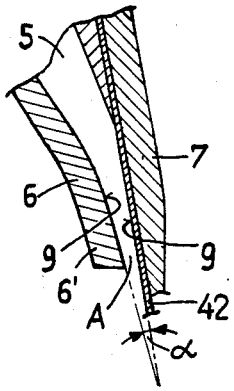
FIG. 1*a* shows a detail, on an enlarged scale, of the headbox shown in FIG. 1.

In the first embodiment of the headbox according to the invention, as shown in FIG. 1, the intermediate lip members 7 are provided with planar or flat outer surfaces 8' which simultaneously form the inner boundaries of the outlet slices or gaps A. The ends 6' of the outer lip members 6 are bent or flexed as shown in FIG. 1 such that the outlet slices A between the outer lip members 6 and the intermediate lip members 7 are bounded by surfaces 9 extending substantially parallel to each other. In the case of surfaces converging in the flow direction of the stock suspension their angle $\alpha$ may, for example, be in a range of between 0° and 10° (see FIG. 1*a*).

As will still be evident from FIG. 1, the intermediate lip members 7 are provided with flexible foils 42 or the like mounted at the guiding or guide members 13. These flexible foils 42 extend past the outlet slices A and B and serve to guide the stock suspension jets effluxing from the individual headbox elements at regions extending beyond the outlet slices A and B.

Figure 5:
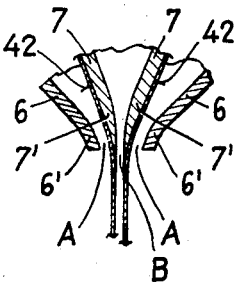
FIG. 5 is a sectional view showing a modified design of the terminal regions or the ends of the intermediate lips or lip members and the outer lips or lip members of the headbox shown in FIG. 1.

Finally, FIG. 5 shows a possible design of the ends or terminal regions of the outer lip members 6 and of the intermediate lip members 7 at the region of the outlet slices A and B. In this case, not only the outer lip members 6 have bent-off ends 6', but here also the intermediate lip members 7 are provided with bent-out ends 7'. With such an arrangement there is moderated the collision or impact of the stock flows exiting from the outlet slices A with the stock flow exiting from the outlet slice B.

Although the multi-ply headbox according to the invention has been illustrated and described, by way of example, with reference to a headbox containing three headbox elements, it will be obvious and should be expressly understood that the headbox may be equipped in the same way with a different number like, for example, two or four headbox elements.

While there are shown and described present preferred embodiments of the invention, it is to be distinctly understood that the invention is not limited thereto, but may be otherwise variously embodied and practiced within the scope of the following claims. Accordingly,

What I claim is:

1. A multi-ply headbox for a papermaking machine comprising:

at least two headbox elements arranged adjacent one another;

each of said at least two headbox elements comprising an infeed member containing distributor channels including turbulence elements for the throughflow of a fiber stock suspension in a predetermined direction of flow;

each of said at least two infeed members being arranged adjacent one another and having substantially wedge-shaped converging side walls;

a predetermined one of said substantially wedge-shaped converging side walls of one of said at least two adjacently arranged infeed members confronting a predetermined one of the other of said at least two adjacently arranged infeed members to define a confronting pair of side walls;

each said headbox element being provided with a nozzle chamber flow communicating with said infeed member thereof;

said nozzle chambers being bounded by outer lip members and at least one relatively rigid intermediate lip member located between said confronting pair of side walls of said two adjacently arranged infeed members and between said nozzle chambers and forming outlet slices;

said at least one relatively rigid intermediate lip member having a lengthwise direction of extent;

said at least one relatively rigid intermediate lip member, which is arranged between said confronting pair of side walls of said at least two adjacently arranged infeed members, being displaceable between said two adjacently arranged infeed members between said confronting pair of side walls in said lengthwise direction of extent of said at least one relatively rigid intermediate lip member for adjusting the size of the outlet slice bounded by said at least one relatively rigid intermediate lip member;

means for adjusting the position of said at least one relatively rigid intermediate lip member by displacement thereof in said lengthwise direction of extent thereof; and said at least one relatively rigid intermediate lip member being structured to cooperate with an adjacent lip member and being displacable between said two adjacently arranged infeed members by said adjusting means such that the displacement of said at least one relatively rigid intermediate lip member is substantially exclusively effective at only one of the outlet slides bounded by said at least one relatively rigid intermediate lip member for altering the size of said one outlet slice without affecting the size of any other ones of said outlet slices.

2. The multi-ply headbox as defined in claim 1, further including:

at least two of said relatively rigid intermediate lip members located between said nozzle chambers; and said adjusting means serving for the adjustment of said relatively rigid intermediate lip members by displacement thereof along said side walls in said lengthwise direction of extent of said relatively rigid intermediate lip members.

3. The multi-ply headbox as defined in claim 1, wherein:

at least some of said infeed members define outer infeed members having substantially planar side walls; and said outer lip members being displaceable along said planar side walls of said outer infeed members.

4. The multi-ply headbox as defined in claim 1, wherein:

said lip members comprise rigid plates bounded by substantially parallel planar surfaces at a region between said infeed members.

5. The multi-ply headbox as defined in claim 2, wherein:

said lip members comprise rigid plates bounded by substantially parallel planar surfaces at a region between said infeed members.

6. The multi-ply headbox as defined in claim 5, further including:

a respective guiding member operatively associated with each lip member;

each said guiding member being mounted at an adjacent infeed member in order to form mechanical guiding means for its lip member.

7. The multi-ply headbox as defined in claim 1, wherein:

at least some of said infeed members define outer infeed members possessing outer walls; and said outer lip members being pivotably supported at the region of said outer walls and being pivotable for adjusting the size of their outlet slice.

8. The multi-ply headbox as defined in claim 2, wherein:

said outer lip members contain outwardly bent ends which are flexed such that the outlet slices between said outer lip members and said intermediate lip members are bounded by surfaces extending substantially parallel to each other.

9. The multi-ply headbox as defined in claim 2, wherein:

said infeed members comprise solid material blocks; and said distributor channels comprise mutually parallel bores formed in each of said blocks.

10. The multi-ply headbox as defined in claim 9, wherein:

said bores are provided with substantially step-shaped widened portions defining said turbulence elements.

11. The multi-ply headbox as defined in claim 2, further including:

flexible foils provided for said intermediate lip members and extending beyond said outlet slices.

12. The multi-ply headbox as defined in claim 9, wherein:

a respective guiding member is operatively associated with each lip member;

said blocks forming said infeed members being interconnected by means of said respective guiding members and by projections containing inclined surfaces in order to form dovetail-type connection arrangements.

13. The multi-ply headbox as defined in claim 12, further including:

slots formed in said intermediate lip members; and said projections engaging said slots to simultaneously serve as spacers as well as guides for said intermediate lip members during the displacement thereof between the infeed members along the side walls thereof.

14. The multi-ply headbox as defined in claim 13, wherein:

said adjusting means for displacing said intermediate lip members between the infeed members along the side walls thereof comprise displacing rod means and angle lever means; and each of said angle levers means being pivotable about a pivot pin and connecting one of said displacing rod means to a respective one of said intermediate lip members for displacing said intermediate lip member.

15. The multi-ply headbox as defined in claim 1, wherein:

said distributor channels of each infeed member extend substantially parallel to each other.

16. The multi-ply headbox as defined in claim 1, wherein:

said at least one intermediate lip member is displaceable between said infeed members from externally of said infeed members; and said adjusting means for adjusting said at least one intermediate lip member being disposed externally of said infeed members.

17. The multi-ply headbox as defined in claim 16, wherein:

said adjusting means for adjusting the position of said at least one intermediate lip member are located on the side of the infeed block which is remote from the nozzle chambers.

18. A multi-ply headbox for a papermaking machine comprising:

infeed block means containing turbulence elements and each connected to a respective one of at least two distributor tubes for a fiber stock suspension;

said infeed block means comprising at least two adjacently arranged infeed members;

each of said at least two adjacently arranged infeed members having substantially wedge-shaped converging side walls and containing mutually parallel distributor channels for the throughflow of said fiber stock suspension in a predetermined direction of flow;

respective nozzle chambers following said infeed block means and flow communicating with respective ones of said at least two adjacently arranged infeed members thereof;

said nozzle chambers being bounded by outer lip members and at least one intermediate lip member located between said nozzle chambers and forming outlet slices;

said at least one intermediate lip member constituting a substantially planar, rigid plate;

said at least one intermediate lip member having a lengthwise direction of extent;

a predetermined one of said substantially wedge-shaped converging side walls of one of said at least two adjacently arranged infeed members confronting a predetermined one of the other of said at least two adjacently arranged infeed members to define a confronting pair of side walls;

said at least one intermediate planar, rigid lip member being arranged for displacement between said confronting pair of said side walls of said at least two adjacently arranged infeed members in said lengthwise direction of extent of said at least one intermediate planar rigid lip member for adjusting the size of the outlet slice bounded by said at least one intermediate planar, rigid lip member;

means for adjusting said at least one intermediate planar, rigid lip member by displacement thereof in said lengthwise direction of extent thereof; and said at least one intermediate planar, rigid lip member being structured to cooperate with an adjacent lip member and being displaceable between said two adjacently arranged infeed members by said adjusting means such that the displacement of said at least one intermediate planar, rigid lip member is substantially exclusively effective at only one of the outlet slices bounded by said at least one intermediate planar, rigid lip member for altering the size of said one outlet slice without affecting the size of any other ones of said outlet slices.

19. A multi-ply headbox for a papermaking machine comprising:

three headbox elements arranged adjacent one another;

each said headbox element comprising an infeed member containing substantially mutually parallel distributor channels including turbulence elements for the throughflow of a fiber stock suspension in a predetermined direction of flow;

each of said infeed members having substantially wedge-shaped converging side walls;

one of said three infeed members constituting an inner infeed member and being arranged between respective two outer ones of said infeed members;

each said headbox element being provided with a nozzle chamber flow communicating with said distributor channels in said infeed member thereof;

said nozzle chambers defining two outer nozzle chambers and an inner nozzle chamber between said two outer nozzle chambers;

each of said two outer nozzle chambers being bounded by a respective outer lip member and a respective relatively rigid intermediate lip member and said inner nozzle chamber being bounded by two of said relatively rigid intermediate lip members;

said outer lip members and said relatively rigid intermediate lip members bounding therebetween said nozzle chambers and forming outlet slices;

each said relatively rigid intermediate lip member being arranged between one of said substantially wedge-shaped converging side walls of the inner infeed member and one of said substantially wedge-shaped converging side walls of an adjacently arranged outer infeed member;

each said relatively rigid intermediate lip member having a lengthwise direction of extent;

each said relatively rigid intermediate lip member being displaceable between said outer and said inner infeed members between said side walls of said inner infeed member and said adjacently arranged outer infeed member in said lengthwise direction of extent of said relatively rigid intermediate lip member for adjusting the size of the outlet slice bounded by said relatively rigid intermediate lip member;

means for adjusting the position of each said relatively rigid intermediate lip member by displacement thereof in said lengthwise direction of extent thereof;

a respective guiding member operatively associated with each one of said relatively rigid intermediate lip members;

each said guiding member being provided with projections;

mounting means provided at said guiding member;

said inner infeed member being provided with projections;

said mounting means and said projections provided at said guiding member and said projections provided at said inner infeed member cooperating with one another in order to mount said outer infeed members at said inner infeed member;

each said relatively rigid intermediate lip member being provided with slots; and said projections provided at said respective guiding members and said projections provided at said inner infeed member engaging into said slots in order to enable the displacement of each said relatively rigid intermediate lip member in the said lengthwise direction of extent thereof.

* * * * *